US010608364B2

(12) United States Patent
Blakborn

(10) Patent No.: US 10,608,364 B2
(45) Date of Patent: Mar. 31, 2020

(54) HIGH-VOLTAGE CONNECTOR

(71) Applicant: Rosenberger Hochfrequenztechnik GmbH & Co. KG, Fridolfing (DE)

(72) Inventor: Willem Blakborn, Inzell (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/097,809

(22) PCT Filed: Apr. 21, 2017

(86) PCT No.: PCT/EP2017/000514
§ 371 (c)(1),
(2) Date: Oct. 30, 2018

(87) PCT Pub. No.: WO2017/190828
PCT Pub. Date: Nov. 9, 2017

(65) Prior Publication Data

US 2019/0123471 A1 Apr. 25, 2019

(30) Foreign Application Priority Data

May 4, 2016 (DE) ..... 10 2016 005 508

(51) Int. Cl.
*H01R 13/44* (2006.01)
*H01R 13/24* (2006.01)
(Continued)

(52) U.S. Cl.
CPC ..... *H01R 13/44* (2013.01); *H01R 13/2421* (2013.01); *H01R 13/53* (2013.01);
(Continued)

(58) Field of Classification Search
CPC .... H01R 13/44; H01R 13/2421; H01R 13/53; H01R 13/621; H01R 2103/00; H01R 2201/26
See application file for complete search history.

(56) References Cited

U.S. PATENT DOCUMENTS 3,474,386 A 10/1969 Link
3,932,933 A * 1/1976 Broad ..... H01R 13/53 29/859
(Continued)

FOREIGN PATENT DOCUMENTS

CN 104319555 A 1/2015
DE 69912508 T2 10/1999
(Continued)

OTHER PUBLICATIONS

Machine translation of JP2006339167A.
Machine translation of CN104319555A.

*Primary Examiner* — Edwin A. Leon
*Assistant Examiner* — Milagros Jeancharles
(74) *Attorney, Agent, or Firm* — David P. Dickerson

(57) ABSTRACT

A connector for a high-voltage connection for electrically connecting high-voltage components, in particular of an electrical drive system of a motor vehicle, said connector comprising at least one electrical contact arrangement, wherein the contact arrangement comprises at least one ring-shaped contact element; a first inner protective element, which is arranged within the contact element and projects relative to the contact element; and a first outer protective element, which at least partly surrounds the contact element and projects relative to the contact element, wherein the first inner protective element and the first outer protective element form a shock protection for the contact element.

23 Claims, 3 Drawing Sheets

(51) Int. Cl.

| | |
|---|---|
| ***H01R 13/53*** | (2006.01) |
| *H01R 103/00* | (2006.01) |
| *H01R 13/621* | (2006.01) |
| *H01R 13/707* | (2006.01) |

(52) U.S. Cl.
CPC ..... *H01R 13/621* (2013.01); *H01R 13/707* (2013.01); *H01R 2103/00* (2013.01); *H01R 2201/26* (2013.01)

(56) References Cited

U.S. PATENT DOCUMENTS 5,554,893 A * 9/1996 Oku ..... A61B 1/00124 307/112
8,298,022 B2 10/2012 Tsuruta et al.
8,858,258 B2 * 10/2014 Stokowski ..... H01R 13/42 439/582
2004/0102060 A1 * 5/2004 Schauz ..... H01R 13/622 439/13
2013/0323954 A1 * 12/2013 Eckel ..... H01R 13/5205 439/271
2015/0229054 A1 8/2015 Fukushima et al.
2015/0325961 A1 * 11/2015 Blakborn ..... H01R 13/713 439/271
2019/0392986 A1 * 12/2019 Sano ..... H01F 27/2823

FOREIGN PATENT DOCUMENTS

DE 102009059089 B3 4/2011
DE 102010035943 A1 3/2012
DE 112011104520 T5 6/2012
DE 102013011577 A1 1/2015
EP 0773602 A2 5/1997
JP 2006339167 A 12/2006

* cited by examiner

HIGH-VOLTAGE CONNECTOR

FIELD OF THE INVENTION

The present invention relates to a high-voltage connector for releasably electrically connecting high-voltage components, in particular of an electrical drive system of a motor vehicle. Furthermore, the invention relates to a high-voltage connection comprising a high-voltage connector according to the invention.

High-voltage components are understood to mean, in particular, the devices and units of an electrical drive system of a motor vehicle (hybrid drive, hybrid, electric or fuel cell vehicle).

High voltages are understood to mean voltages of at least 60 V DC voltage or 30 V AC voltage.

Hereinafter, HV stands for "high-voltage".

TECHNICAL BACKGROUND

In electric or hybrid vehicles driven wholly or partly by electric current, very high currents and/or voltages are transmitted via the connector elements and thus the electric contacts installed therein.

Owing to the high currents and/or voltages, particularly stringent safety requirements are made of the connector elements. In this regard, by way of example, the standards of the VDE (German Association of Electrical Engineering), such as e.g. VDE 0470, and European standards, such as e.g. IEC/EN 61032, stipulate that the contact elements must be afforded protection in respect of being touched by a human finger. For a corresponding test, a so-called test finger is provided, which is intended to simulate a human fingertip and is pressed with a prescribed test force against sections or openings of the connector element via which the contact elements are accessible, without being permitted to come into contact with current-carrying sections of the contact elements in the process.

The prior art discloses a multiplicity of connector elements in which the contact elements are intended to be prevented from being touched in various ways. In this regard, the contact elements themselves can be provided with shock protection bodies or be concealed with the aid of movable shock protection devices in an open state of the connectors such that they comply with the corresponding standards or regulations for shock protection. In a final connected state of the connectors, the movable shock protection devices are withdrawn in order that the contact elements can be contacted by mating contact elements.

By way of example, the document DE 10 2010 035 943 A1 discloses a connector for high-voltage applications having a housing, on which are shaped electrically insulating walls that project beyond the upper and side edges of a flat connector pin held by the housing to an extent such that a human finger ought to be able to touch the edges of the walls, without making touching contact with the flat connector pin.

On account of the maximum distances to be complied with between the contact surfaces and the shock protection, the contact surfaces of a connector often have only a small surface area. However, this has a disadvantageous effect on the temperature distribution in an HV connection.

This is a state in need of improvement.

SUMMARY OF THE INVENTION

Against this background, the present invention is based on the object of specifying an improved HV connection.

This object is addressed by the embodiments recited in the independent claims. Further embodiments are recited in the dependent claims.

Accordingly, provision is made of:

A connector for a high-voltage connection for electrically connecting high-voltage components, in particular of an electrical drive system of a motor vehicle, said connector comprising at least one electrical contact arrangement, wherein the contact arrangement comprises at least one ring-shaped contact element; a first inner protective element, which is arranged within the contact element and projects relative to the contact element; and a first outer protective element, which at least partly surrounds the contact element and projects relative to the contact element, wherein the first inner protective element and the first outer protective element form a shock protection for the contact element.

A high-voltage connection for electrically connecting high-voltage components, in particular of an electrical drive system of a motor vehicle, comprising a first connector and comprising a second connector, wherein the high-voltage connection comprises a contact arrangement and a mating contact arrangement corresponding to the contact arrangement, wherein the contact arrangement and respectively the mating contact arrangement comprise a contact element and respectively a mating contact element corresponding to the contact element; a first and respectively a second inner protective element, which is arranged within the contact element and respectively the mating contact element and projects relative to the contact element and respectively the mating contact element; and a first and respectively a second outer protective element, which at least partly surrounds the contact element and respectively the mating contact element and projects relative to the contact element and respectively the mating contact element, wherein the first and second inner protective elements and the first and second outer protective elements of the first and second connectors are able to be plugged together.

The insight underlying the present invention consists in configuring the contact element in ring-shaped fashion and thus increasing the surface area of the contact element and at the same time not exceeding a maximum distance between the contact element and the protective element, in such a way that a test finger cannot touch the contact element.

Advantageous configurations and developments are evident from the further dependent claims and from the description with reference to the figures of the drawing.

In accordance with one preferred embodiment of the invention the contact element comprises a contact surface configured obliquely relative to a longitudinal axis of the high-voltage connection. By inclining or bending the contact surface, the surface area thereof can be increased further, without increasing the distance between the shock protection and the contact element in the process.

Furthermore, the surface of the contact element can be provided with a suitable profile in order that the contact element and a connected mating contact element of a second connector deform in an expedient manner under temperature influence.

Experiments have revealed that given a suitable surface constitution of the contact element and/or of the mating contact element, the surfaces thereof mold against one another, thereby improving the contact between the contact element and the mating contact element.

The longitudinal axis in a straight connector extends in the direction of the connections to be produced. By contrast, an angular connector has two longitudinal axes, which generally form an angle of 90°.

In accordance with a further preferred embodiment of a connector according to the invention, the contact element is configured as a round or spherical contact or as a cone-type or conical contact. The term round contact also encompasses, in particular, round-like shapes such as elliptical shapes or parabolic shapes.

In accordance with one preferred embodiment of the invention, the connector comprises a thread in order to screw the connector to a further connector to be connected. A screw connection is particularly robust and long-lived and advantageous in particular if the connection is opened and closed exclusively by trained specialist personnel for maintenance or mounting purposes.

In accordance with one preferred embodiment, the thread is formed outside a sealed region of the connector. This obviates the need for sealing of the thread or of the screw connection in the thread.

In accordance with a further preferred embodiment, a connector according to the invention comprises a spring, in particular a helical spring or a leaf spring. The spring is configured to exert on the contact arrangement a pretensioning force in the direction of a mating contact arrangement to be contacted of a second connector. This ensures that a press-on force acts on the contact element and/or the mating contact element in the connected state of the connector according to the invention. The press-on force further promotes the temperature-dependent surface deformation of the contact element and/or of the mating contact element 202.

Furthermore, the spring provides a tolerance compensation for component parts exhibiting tolerances.

In accordance with one preferred embodiment of the invention, the connector according to the invention comprises a high-voltage monitoring circuit configured, before disconnecting the contact arrangement with a mating contact arrangement of a second connector, said mating contact arrangement corresponding to the contact arrangement, to disconnect the contact arrangement from a voltage source. HV monitoring circuits of this type are also referred to by experts as a High-Voltage Interlock Loop (HVIL) system. Systems of this type are intended to further reduce the risk of injury for a user by virtue of the fact that, prior to disconnecting the contact arrangement, at least the connection to a voltage source is interrupted or a discharge of the contact arrangement and/or mating contact arrangement is ensured.

In accordance with one preferred embodiment of the invention, the shock protection comprises ceramic and/or plastic, in particular polyamide and/or polybutylene terephthalate.

In accordance with one preferred embodiment, the first inner protective element is configured in bipartite fashion. The first inner protective element comprises in particular an upper shock protection cap and a lower peg. In this way, the first inner protective element can be constructed particularly advantageously with regard to its material properties. In this regard, a material that especially imparts stability and has a low thermal expansion can be chosen for the peg, whereas an especially insulating material can be used for the shock protection cap.

In principle, virtually all temperature-resistant, nonconductive materials are suitable for a shock protection cap.

In accordance with a further preferred embodiment of the invention, the contact element comprises aluminum and/or copper. Aluminum and copper have particularly expedient electrical properties. Furthermore, aluminum and copper ensure particularly positive deformation properties of a contact element or mating contact element 202 under temperature influence.

In accordance with a further preferred embodiment of the invention, the outer protective element has a partly circumferential protective wall. The structural space of a connector according to the invention can thus be reduced, if necessary. For this purpose, a circumferential protective wall is interrupted in such a way that it is configured in partly circumferential fashion. What is crucial here is that the interruption does not exceed a maximum distance between the shock protection, in such a way that a test finger is also still not able to touch the contact element.

Moreover, this embodiment is advantageous particularly for angular connectors by virtue of the fact that an angular connection can be produced particularly simply.

In accordance with a further preferred embodiment of the invention, the outer protective element comprises at least one protective pin or at least one receptacle for a protective pin between ends of the protective wall.

In this way, a first or second connector can be held particularly simply in a second or respectively first connector of an angular connection.

In accordance with one preferred embodiment, the connector is configured as a multi-pole, in particular as a two-pole, connector. A compact structural space or a sufficient current transfer volume is ensured by a suitable choice of the number of poles.

The above configurations and developments can be combined with one another in any desired manner, if expedient. Further possible configurations, developments and implementations of the invention also encompass combinations not explicitly mentioned of features of the invention described above or below with regard to the exemplary embodiments. In particular, here the person skilled in the art will also add individual aspects as improvements or supplementations to the respective basic form of the present invention.

BRIEF DESCRIPTION OF THE DRAWINGS

The present invention is explained in greater detail below on the basis of the exemplary embodiments indicated in the schematic figures of the drawing, in which.

Figure 1:
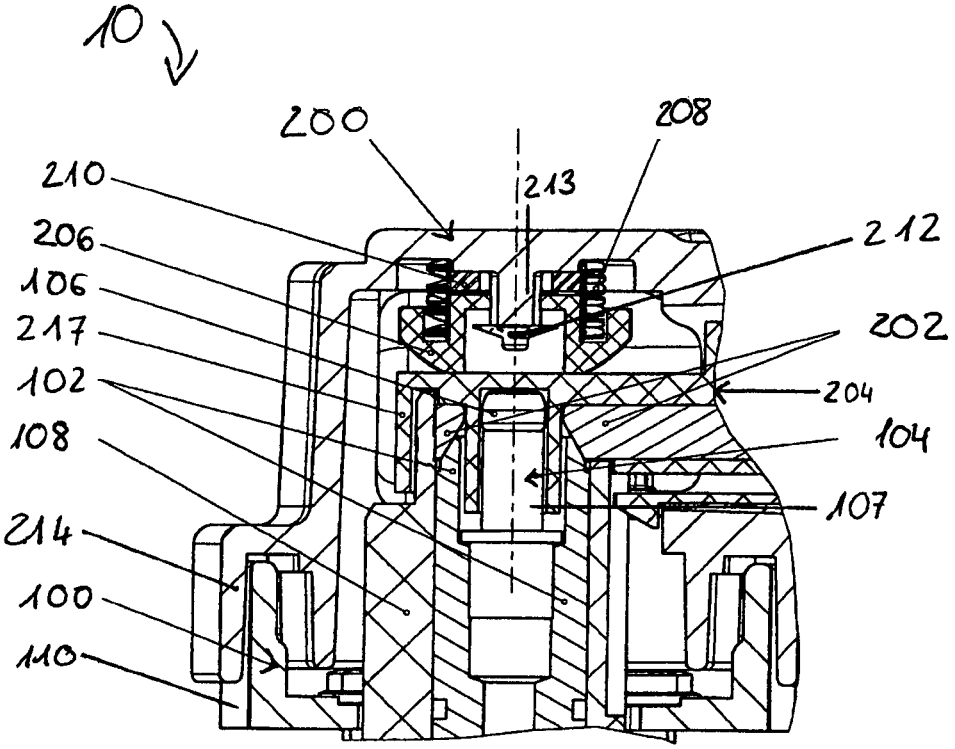
FIG. 1 shows a sectional view of one embodiment of an HV connection according to the invention.

The accompanying figures of the drawing are intended to convey a further understanding of the embodiments of the invention. They illustrate embodiments and, in association with the description, serve to clarify principles and concepts of the invention. Other embodiments and many of the advantages mentioned are evident in view of the drawings.

The elements of the drawings are not necessarily shown in a manner true to scale with respect to one another.

In the figures of the drawing, identical, functionally identical and identically acting elements, features and components—unless explained otherwise—are provided in each case with the same reference signs.

DESCRIPTION OF EXEMPLARY EMBODIMENTS

Although the present invention has been described completely above on the basis of preferred exemplary embodiments, it is not restricted thereto, but rather can be modified in diverse ways.

FIG. 1 shows an HV connection according to the invention comprising a first connector, configured as unit connection, and comprising a second connector, configured as cable connection.

It is evident from the text that follows that the designation of the first connector and of the second connector, respectively, can also be interchanged. In particular, the designation of the elements of the first connector and of the mating elements of the second connector, respectively, can also be interchanged.

The first connector 100 comprises two contact arrangements or two contact poles having a respective contact element 102, a respective first inner protective element 104 and a respective first outer protective element 108. The second connector 200 comprises two mating contact arrangements configured in a manner corresponding to the contact arrangement. The mating contact arrangement comprises in each case a mating contact element 202 and in each case a second outer protective element 217 and a second inner protective element 216.

For simplification, reference is made below only to one contact arrangement and one mating contact arrangement, even though a two-pole connection is illustrated. In the embodiments illustrated, the contact elements 102 and the mating contact elements 202 are configured as end contacts. End contact means that an electrical contact is produced between two end sides.

The contact arrangement of the first connector 100 comprises an insulating part 103 having a contact arrangement having a ring-shaped contact element 102. The contact element 102 has bent contact surfaces and is configured as a round contact. The contact surface of the contact element 102 is furthermore beveled, as a result of which the contact surface is enlarged with the structural space remaining the same. An increase in the area of the contact surface reduces the transferred current density per unit area on the contact surface. Consequently, the heating of the contact element 102 during current transfer proves to be lower.

The first inner protective element 104 is formed within the ring-shaped contact element 102 of the first connector 100. The first inner protective element 104 comprises a peg 107, on which the cap 106 is formed. The peg 107 can be produced for example from a conductive material, in particular metal, whereas the cap 106 is produced from non-conductive material.

The first outer protective element 108 is formed outside the ring-shaped contact element 102, in a manner surrounding the ring-shaped contact element. The first inner protective element 104 and the first outer protective element 108 are arranged concentrically with respect to one another and together form a shock protection for the contact element 102. The distance between the inner and outer protective elements 104, 108 is not permitted to exceed a maximum distance, with the result that a test finger or a finger of a user cannot touch the contact surface of the contact element 102. In this case, the maximum distance between the outer protective element 108 and the inner protective element 104 depends on the height of the projection of the outer protective element 108 and of the inner protective element 104 relative to the contact element 102. That is to say that the higher the outer protective element 108 and the inner protective element 104 project relative to the contact element 102, the greater the permissible maximum distance between the outer protective element 108 and the inner protective element 104.

In FIG. 1, the ring-shaped contact element 102 is contacted with a mating contact element. The mating contact element 202 has contact surfaces corresponding to the contact element 102. Accordingly, the contact surfaces of the mating contact element 202 are likewise rounded, bent and quenched. The second connector 200 in FIG. 1 comprises a second inner, cylindrical protective element 216, which is arranged in a manner corresponding to the first inner protective element 104 of the first connector 100 to the effect that the second cylindrical inner protective element 216 of the second connector 200 accommodates in itself the first inner protective element 104 of the first connector 100 in the connected state. The second inner protective element 216 is surrounded by the mating contact element 202.

Furthermore, a second outer protective element 217 is set up in the second connector 200, and partly surrounds the mating contact element 202. The second outer protective element 217 of the second connector 200 is configured in a manner corresponding to the first outer protective element 108 of the first connector to the effect that the second outer protective element 217 partly surrounds the first outer protective element 108. Consequently, in the HV connection illustrated in FIG. 1, the second outer protective element 217, the first outer protective element 108, the mating contact element 202, the contact element 102, the second inner protective element 216 and the first inner protective element 104 are arranged concentrically with respect to one another.

Furthermore, the second connector 200 comprises a spring 208, configured as a compression spring. The spring 208 is inserted into a ring-shaped recess of a flange 206 and is connected to the insulating part 204 of the second connector 200 via said flange. In this way, the spring 208 exerts a compressive force in the direction of the first connector 100 via the flange 206, such that the mating contact element 202 is pressed against the contact element 102. Furthermore, the second connector 200 comprises a guide 213 and a stop 212 for the flange 206, such that the flange 206 is guided linearly in the second connector 200 along a longitudinal axis L and is secured by the stop 212 against slipping out of the guide 212. The flange 206 is placed onto the guide 212 via a hole formed centrally in the flange 206.

In addition, a damping 210 is formed between the flange 206 and the housing 214 of the second connector 200. The damping 210 can be produced for example from heat-resistant rubber or plastic.

Figure 2:
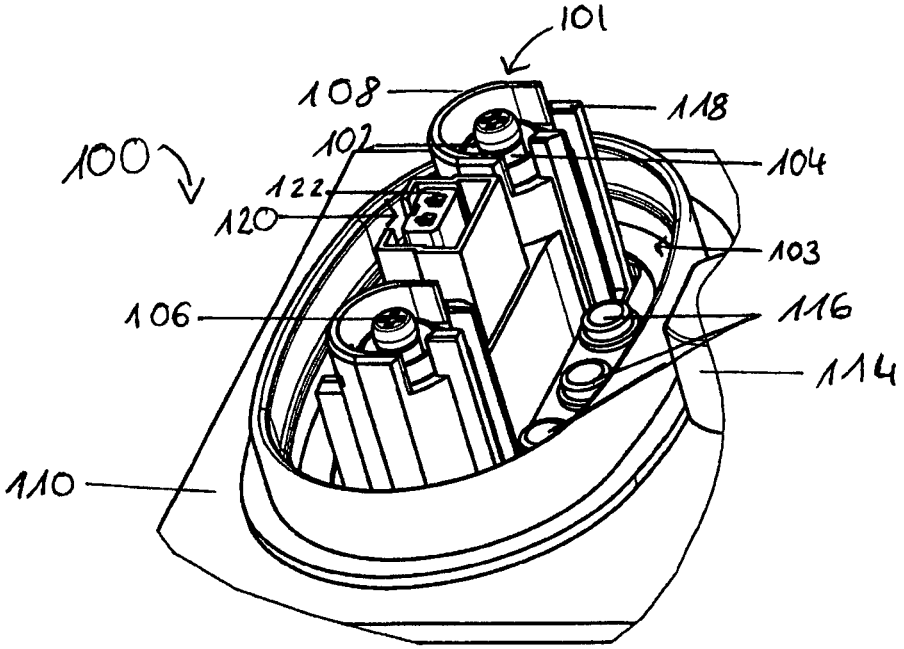
FIG. 2 shows a perspective view of one embodiment of a connector according to the invention.

FIG. 2 shows a first connector 100 in accordance with FIG. 1 in a perspective view. FIG. 2 reveals that the first outer protective element 108 is formed only partly circumferentially. The first outer protective element 108 is configured as a partly circumferential wall with two protective pins 118 between ends of the partly circumferential wall. In the case of angular connectors, the partly circumferential wall of the first outer protective element 108 ensures a particularly compact and simple design. In this case, the ends of the partly circumferential wall are adjacent to the protective pins 118 in such a way that a maximum distance between an end of the partly circumferential wall and a closest protective pin 118 is not undershot. Accordingly, the maximum permissible distance between the protective pins 118 may not be exceeded either. In this regard, as many protective pins 118 as desired can be provided.

The insulating part 103 is screwed to the housing 110 of the first connector 100 by way of three screws 116.

A guide 120 is formed between the contact arrangements of the first connector 100, said guide being configured to guide the first connector 100 and/or the second connector 200 during a connection movement. The guide 120 of the first connector 100 is formed in a manner corresponding to a guide 222 of the second connector 200. An HVIL contact chamber 122 is formed within the guide 120 of the first connector 100. The HVIL contact chamber 122 together with an HVIL bridge 224 in the second connector 200 forms an HVIL system.

FIG. 2 illustrates that the housing 110 of the first connector 100 has an approximately elliptical wall. The elliptical wall can optionally be provided with a sealant (not illustrated). The inner region of the approximately elliptical wall shall be designated hereinafter by sealing region. A base 114 is formed outside the sealing region. The base 114 has a hole having a thread, at which the first connector 100 can be screwed to a corresponding second connector 200.

Figure 3:
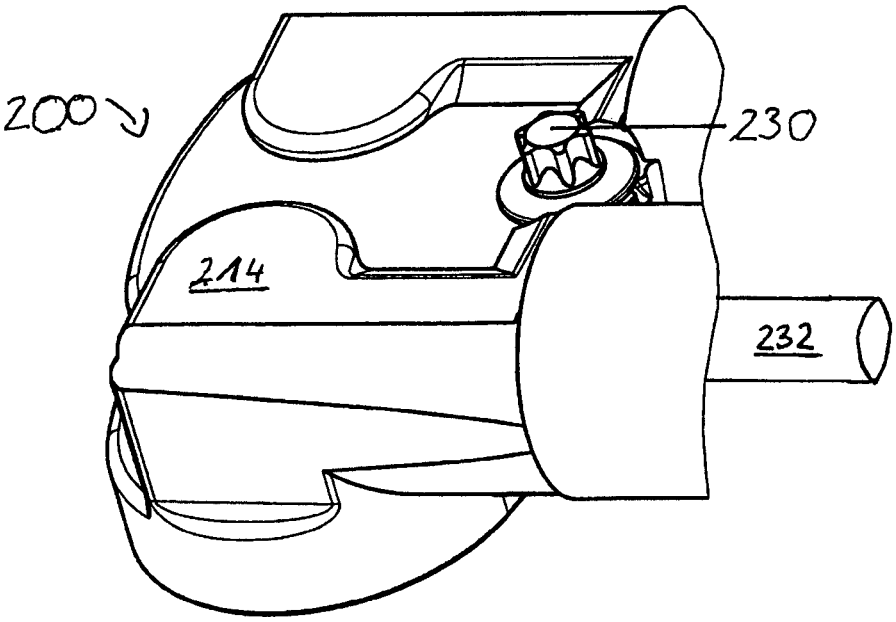
FIG. 3 shows a perspective view of one embodiment of a connector according to the invention.
Figure 4:
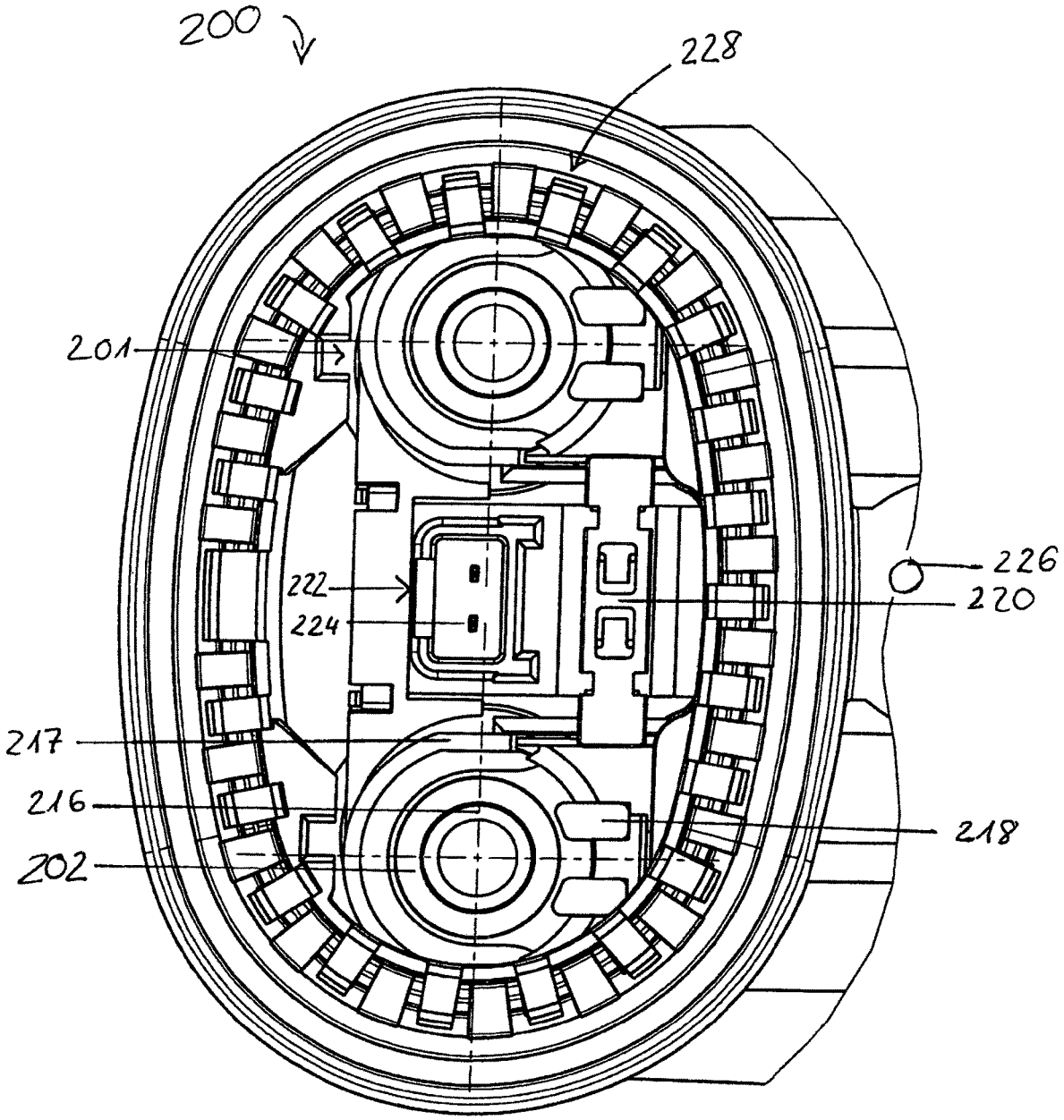
FIG. 4 shows a plan view of one embodiment of a connector according to the invention.

FIGS. 3 and 4 show a second connector 200 in accordance with FIG. 1 in a perspective view and in a plan view. FIG. 3 shows the screw 230 that screws the first connector to the second connector via the base 114. Furthermore, a cable connection is indicated schematically in FIG. 3. It goes without saying that a two-pole connector comprises two cables 232, even though only one cable 232 is illustrated in FIG. 3.

FIG. 4 furthermore illustrates a secondary securing arrangement 220, which secures cable assemblies, for example cable contacts and/or insulating parts in the housing, against being inadvertently pulled out. In addition, a hole having a thread corresponding to the screw 230 is indicated schematically.

As is illustrated in FIG. 4, the second connector 200 also comprises a partly circumferential second outer protective element 217. The second partly circumferential outer protective element 217 has two receptacles 218 configured to receive the protective pins 118 of a first connector.

LIST OF REFERENCE SIGNS

10 HV connection
100 First connector
102 Contact element
103 Insulating part
104 First inner protective element
106 Cap
107 Peg
108 First outer protective element
110 Housing
114 Base
116 Screws
118 Protective pin
120 Guide
122 HVIL contact chamber
200 Second connector
202 Mating contact element
204 Insulating part
206 Flange
208 Spring
210 Damping
212 Stop
213 Guide
214 Housing
216 Second inner protective element
217 Second outer protective element
218 Receptacle
220 Secondary securing arrangement
222 Guide
224 HVIL bridge
226 Hole
228 Holding element
230 Screw
232 Cable
L Longitudinal axis

The invention claimed is:

1. An electrical connector, comprising:
a contact element having an annular cross-section;
a first protective element inward of said contact element;
a second protective element that surrounds at least part of a circumference of said contact element; and
a radial gap between said contact element and said first protective element, wherein
said first protective element and said second protective element extend substantially beyond a leading portion of said contact element in an insertion direction, wherein
a central axis of said first protective element is substantially coaxial to a central axis of said contact element.

2. The electrical connector of claim 1, wherein:
said radial gap receives a portion of a third protective element of a counterpart connector in a coupled state of said electrical connector and said counterpart connector.

3. The electrical connector of claim 1, wherein:
said radial gap receives a portion of a second contact element of a counterpart connector in a coupled state of said electrical connector and said counterpart connector.

4. The electrical connector of claim 1, wherein:
said contact element comprises a leading contact surface that is oblique relative to a longitudinal axis of said electrical connector.

5. The electrical connector of claim 1, wherein:
said contact element comprises a curved contact surface.

6. The electrical connector of claim 1, comprising:
a spring, electrically insulated from said contact element, said spring inducing a contact force between said contact element and a second contact element of a counterpart connector, wherein
a central axis of said spring is substantially coaxial to said central axis of said contact element.

7. The electrical connector of claim 1, wherein:
said first protective element and said second protective element consist of an electrically insulating material.

8. The electrical connector of claim 1, wherein:
said second protective element and a first portion of said first protective element consist of an electrically insulating material, and
a second portion of said first protective element consists of an electrically conductive material.

9. The electrical connector of claim 1, wherein:
said second protective element comprises a wall that surrounds at least a first part of a circumference of said contact element and at least one peg situated outward of a second part of said circumference.

10. The electrical connector of claim 9, wherein:
said wall and said at least one peg consist of an electrically insulating material.

11. The electrical connector of claim 1, wherein:

said extending of said first protective element and said second protective element substantially beyond said leading portion of said contact element in an insertion direction provides touch protection for a human finger.

12. An electrical connector, comprising:

a tubular contact element;

a first protective element situated in a hollow of said tubular contact element;

a second protective element that surrounds at least part of a circumference of said tubular contact element; and a radial gap between said tubular contact element and said first protective element, wherein said first protective element and said second protective element extend substantially beyond a distal end of said tubular contact element, wherein a central axis of said first protective element is substantially coaxial to a central axis of said contact element.

13. The electrical connector of claim 12, wherein:

said radial gap receives a portion of a third protective element of a counterpart connector in a coupled state of said electrical connector and said counterpart connector.

14. The electrical connector of claim 12, wherein:

said tubular contact element comprises a leading contact surface that is oblique relative to a longitudinal axis of said electrical connector.

15. The electrical connector of claim 12, wherein:

said tubular contact element comprises a curved contact surface.

16. The electrical connector of claim 12, comprising:

a spring, electrically insulated from said tubular contact element, said spring inducing a contact force between said tubular contact element and a second contact element of a counterpart connector, wherein a central axis of said spring is substantially coaxial to said central axis of said contact element.

17. The electrical connector of claim 12, wherein:

said first protective element and said second protective element consist of an electrically insulating material.

18. The electrical connector of claim 12, wherein:

said second protective element and a first portion of said first protective element consist of an electrically insulating material, and a second portion of said first protective element consists of an electrically conductive material.

19. The electrical connector of claim 12, wherein:

said second protective element comprises a wall that surrounds at least a first part of a circumference of said contact element and at least one peg situated outward of a second part of said circumference.

20. The electrical connector of claim 19, wherein:

said wall and said at least one peg consist of an electrically insulating material.

21. The electrical connector of claim 19, wherein:

said first protective element, said wall and said at least one peg are configured and arranged to prevent a human finger from contacting said contact element.

22. The electrical connector of claim 12, wherein:

said extending of said first protective element and said second protective element substantially beyond said distal end of said tubular contact element provides touch protection for a human finger.

23. An electrical connector, comprising:

a contact element having an annular cross-section;

a first protective element inward of said contact element;

a second protective element that surrounds at least part of a circumference of said contact element; and a radial gap between said contact element and said first protective element, wherein said first protective element and said second protective element extend substantially beyond a leading portion of said contact element in an insertion direction so as to provide touch protection for a human finger, and said contact element comprises a leading contact surface that is oblique relative to a longitudinal axis of said electrical connector.

* * * * *